US006173593B1

(12) United States Patent
Liermann

(10) Patent No.: US 6,173,593 B1
(45) Date of Patent: Jan. 16, 2001

(54) CONCEALED LOCKING MECHANISM AND METHOD FOR USE WITH DRAWERS OR CABINET DOORS OR THE LIKE

(76) Inventor: Christopher John Liermann, 1793 Julie Cir., Simi Valley, CA (US) 93065

( * ) Notice: Under 35 U.S.C. 154(b), the term of this patent shall be extended for 0 days.

(21) Appl. No.: 09/285,903

(22) Filed: Apr. 2, 1999

(51) Int. Cl.[7] ..... E05B 65/44

(52) U.S. Cl. ..... 70/78; 70/85; 70/333 A; 292/DIG. 65

(58) Field of Search ..... 70/78, 79, 80, 70/81, 84, 85, 333 A, 416, 423, 455; 292/DIG. 65; 312/333

(56) References Cited

U.S. PATENT DOCUMENTS

| | | | | |
|---|---|---|---|---|
| 2,094,895 | * | 10/1937 | Karpenske et al. | 45/94 |
| 2,182,307 | * | 12/1939 | Behnke | 70/80 |
| 2,886,392 | * | 5/1959 | Stegmaier | 312/217 |
| 3,397,001 | * | 8/1968 | Friedman | 292/87 |
| 3,850,463 | * | 11/1974 | Hawkins | 292/67 |
| 3,909,090 | * | 9/1975 | Breckner et al. | 312/217 |
| 3,918,752 | * | 11/1975 | Leone et al. | 292/174 |
| 4,378,948 | * | 4/1983 | Chrones | 292/19 |
| 4,416,477 | * | 11/1983 | Bialobrzeski et al. | 292/19 |
| 4,460,222 | * | 7/1984 | Larking | 312/286 |
| 4,991,416 | * | 2/1991 | Resendez, Jr. et al. | 70/312 |
| 5,147,099 | * | 9/1992 | McLinden et al. | 292/175 |
| 5,172,097 | * | 12/1992 | Arnold | 340/543 |
| 5,445,451 | * | 8/1995 | Harmony | 312/333 |
| 5,626,372 | * | 5/1997 | Vogt | 292/87 |
| 5,711,554 | * | 1/1998 | Brown et al. | 292/19 |

FOREIGN PATENT DOCUMENTS

| | | | | |
|---|---|---|---|---|
| 2083541 | * | 3/1982 | (GB) | 292/DIG. 65 |
| 2129482 | * | 5/1984 | (GB) | 70/85 |

* cited by examiner

*Primary Examiner*—Teri Pham Luu
(74) *Attorney, Agent, or Firm*—Lance Kreisman

(57) ABSTRACT

An improved locking mechanism and method for securing drawers and cabinet doors is disclosed which allows the drawers and cabinet doors to be only partially opened until the locking mechanism is unlocked. When the drawer or cabinet door is closed, the hidden locking mechanism of the present invention is entirely concealed from view behind the drawer or cabinet door. The locking mechanism of the present invention allows the drawer or cabinet door to be opened sufficiently to expose the locking mechanism, but effectively prevents the drawer or cabinet door from being more than slightly opened until the locking mechanism is unlocked. When the locking mechanism is unlocked, the drawer or cabinet door may then be fully opened.

22 Claims, 3 Drawing Sheets

CONCEALED LOCKING MECHANISM AND METHOD FOR USE WITH DRAWERS OR CABINET DOORS OR THE LIKE

BACKGROUND OF THE INVENTION

Field of the Invention

The present invention relates generally to locking mechanisms and methods of locking drawers and cabinet doors, and more particularly to an improved locking mechanism and a method of installing such a locking mechanism to prevent a drawer or a cabinet door from being fully opened when locked, the locking mechanism being concealed from view until the drawer or cabinet door is opened slightly and effectively preventing the drawer or cabinet door from being fully opened until the locking mechanism is unlocked.

A wide variety of locking mechanisms for use with drawers or cabinet doors have been developed for use in preventing access to the contents of such drawers or cabinets. There have been two prevalent reasons for using such locking mechanisms: first, to secure the contents of a drawer or cabinet; and second, to prevent children from gaining access to dangerous or fragile contents of a drawer or cabinet.

While the first reason has always required the use of a positive locking mechanism, the second reason has resulted in a wide variety of mechanical latches which are designed to be opened by adults while preventing at least small children from opening them. Unfortunately, all too often, small children are able to easily open such mechanical latches, while adults are able to open them only with considerable difficulty. Accordingly, the present invention is concerned with a locking mechanism rather than with a latching mechanism.

As might well be expected, the art is replete with examples of such locking mechanisms. Four examples of locking mechanisms illustrated in the art will be mentioned briefly. The first, which is illustrated in U.S. Pat. No. 2,094,895, to Karpenske et al., shows a locking mechanism for securing drawers in a desk. A key lock contained in the top center drawer of the desk actuates a mechanism which locks all of the drawers in the desk. In a further aspect, Karpenske et al. teach the use of the locking mechanism to secure handles in a recessed position within the drawers until the drawers are unlocked, at which time the handles are released so that they may be used to pull the drawers out.

While the Karpenske et al. reference is quite clever in its construction, it has the considerable drawback that it requires a highly complex mechanism which must be built into both the frame of the desk and the drawers. This mechanism is simply not readily adaptable for use with either previously installed drawers or with cabinet doors.

A second type of locking mechanism for use with drawers is illustrated in U.S. Pat. No. 3,909,090, to Breckner et al. The Breckner et al. reference teaches an interlocking drawer locking mechanism for use with a multi-drawer filing cabinet to prevent more than one drawer from being opened at a time. This mechanism is useful to prevent the weight of the contents of the drawers from tipping the filing cabinet over if more than one drawer is opened at the same time.

Unfortunately, like the Karpenske et al. reference discussed above, the Breckner et al. reference requires a mechanism that is built in and is not readily adaptable to installation at a later time. In addition, it actually does not lock any of the drawers in a filing cabinet; rather, Breckner et al. allows all of the drawers to be opened, but just one at a time.

A third type of locking mechanism is illustrated by U.S. Pat. No. 2,886,392, to Stegmaler. The Stegmaler reference also shows a filing cabinet locking system, with a combination lock mounted on one drawer being used to lock all of the drawers in the filing cabinet. When the combination lock is unlocked, the drawer on which the combination lock is mounted may be slid partly out to unlock all of the other drawers. Just like the other references previously mentioned, the Stegmaler reference is built into the filing cabinet and is not particularly adaptable for use with existing drawers or cabinet doors.

Finally, one additional reference will be mentioned by way of example to illustrate the complexity of much of the previously known art. U.S. Pat. No. 4,460,222, to Larking, teaches a drawer apparatus with a relatively simple locking mechanism. The Larking device is a drawer for use in banks and similar secure applications, with a simple mechanism used to prevent it from being opened from the outside once it has been locked from the inside. Even the simple mechanism disclosed in Larking must be built in, and is simply not adaptable for use on unsecured drawers without a great deal of difficulty.

It is accordingly the primary objective of the present invention that it provide a locking mechanism which may be installed to releasably secure a single drawer or a cabinet door. It is a further principal objective of the present invention that the locking mechanism be completely invisible until and unless the drawer or the cabinet door is partially opened. As such, it is a related objective of the present invention that it allow the drawer or the cabinet door on which it is installed to be opened sufficiently to allow access to the locking mechanism so that it may be unlocked, but that it effectively deny access to the contents of the drawer or the cabinet unless and until it is unlocked.

It is a further objective of the hidden locking mechanism of the present invention that it be quick and easy to lock and unlock. It is yet a further objective of the hidden locking mechanism of the present invention that it be sufficiently flexible to allow its use on a variety of different size and configuration drawers and cabinet doors without requiring a wide variety of different configurations to be provided, and that it be installable using only simple hand tools. It is a still further objective of the hidden locking mechanism of the present invention that it be configurable as either a key lock or a combination lock, and that it categorically prevent children from unlocking the locking mechanism unless they have the key or the combination.

The hidden locking mechanism of the present invention must be of a construction which is both durable and long lasting, and it should also require little or no maintenance to be provided by the user throughout its operating lifetime. In order to enhance the market appeal of the hidden locking mechanism of the present invention, it should also be of inexpensive construction to thereby afford it the broadest possible market. Finally, it is also an objective that all of the aforesaid advantages and objectives of the hidden locking mechanism of the present invention be achieved without incurring any substantial relative disadvantage.

SUMMARY OF THE INVENTION

The disadvantages and limitations of the background art discussed above are overcome by the present invention. With this invention, a two component hidden locking mechanism is presented for installation to releasably secure a furniture storage compartment such as a drawer or a cabinet. The two components of the hidden locking mechanism of the present invention are a retention mechanism and a bolt which may be releasably engaged by the retention mechanism. One of the components of the hidden locking mechanism is mounted onto the moveable member of the furniture storage compartment (a drawer or a cabinet door), and the other component of the hidden locking mechanism is mounted onto the fixed member of the furniture storage compartment (the frame into which the drawer installed or onto which the cabinet door is mounted). Both the retention mechanism and the bolt are mounted so that they are hidden when the drawer or cabinet door is closed.

The proximal end of the bolt is mounted onto a mounting plate, with the distal end of the bolt extending outwardly from the mounting plate. The retention mechanism has an aperture located therein for receiving the distal end of the bolt therein. The distal end of the bolt has a projection extending therefrom (or, alternatively, a notch located therein) which may be releasably engaged by a tumbler contained within the retention mechanism.

When the retention mechanism is locked, the tumbler will engage the distal end of the bolt and prevent it from being withdrawn from the retention mechanism. When the retention mechanism is unlocked, the tumbler will be disengaged from the distal end of the bolt and will allow it to be withdrawn from the retention mechanism. The retention mechanism may use either a combination lock or a key lock to control the operation of the tumbler, with either type of lock being well known in the art.

When the hidden locking mechanism of the present invention is used with a drawer, in a first embodiment the retention mechanism may be mounted on the inside of the front panel of the drawer. The retention mechanism will thus be completely hidden when the drawer is closed. In this embodiment, the bolt is mounted onto the frame of the drawer so that the bolt will move into the aperture in the retention mechanism, where its distal end may be engaged by the tumbler of the retention mechanism.

The bolt and the retention mechanism are configured to allow sufficient movement of the distal end of the bolt between first and second positions within the retention mechanism to allow the drawer to be opened sufficiently to expose the lock of the retention mechanism. Thus, once the bolt is engaged in the retention mechanism, the drawer will be allowed to move between its fully closed position and a position in which it is opened only sufficiently to expose the lock of the retention mechanism. When the lock is unlocked, the bolt will be released from the retention mechanism, allowing the drawer to be fully opened.

In a second embodiment of the hidden locking mechanism of the present invention used with a drawer, the retention mechanism may be mounted under the top side of the frame of the drawer. Again, the retention mechanism will be completely hidden when the drawer is closed. In this embodiment, the bolt is mounted on the inside of the front panel of the drawer so that as the drawer is closed, the bolt will move into the aperture in the retention mechanism, where its distal end will be engaged by the tumbler of the retention mechanism.

If desired, the bolt may be mounted on its mounting plate so that it may pivot between a deployed position and a folded position. In the deployed position, the bolt will be engaged by the retention mechanism when the drawer is closed, allowing the hidden locking mechanism of the present invention to lock the drawer. In the folded position, the bolt will lie close adjacent its mounting plate or the surface on which its mounting plate is mounted, allowing the drawer to be closed without being locked.

The hidden locking mechanism of the present invention may also be used with a hinged cabinet door. Preferably, in this application the bolt is curved between its proximal and distal ends to allow for the pivoting motion of the cabinet door. This curve in the bolt will allow it to smoothly move into the aperture contained in the retention mechanism. Alternately, the pivoting bolt described above may be used with application of the hidden locking mechanism of the present invention with cabinet doors.

In a first embodiment, the retention mechanism may be mounted in the frame of a cabinet door, underneath the top of the frame and adjacent the side opposite the hinges. In this embodiment, the bolt is mounted on the inside of the cabinet door, near the top and the side opposite the hinges. When the cabinet door is closed, the bolt will move into the aperture in the retention mechanism, where its distal end will be engaged by the tumbler of the retention mechanism. The bolt and the retention mechanism will allow sufficient movement of the distal end of the bolt within the retention mechanism to allow the cabinet door to be opened sufficiently to expose the lock of the retention mechanism.

In a second embodiment, the retention mechanism may be mounted on the inside of the cabinet door, in a convenient position on the side opposite the hinges. In this embodiment, the bolt is mounted in the frame of a cabinet door, adjacent the side opposite the hinges and in a position to be engaged by the retention mechanism when the cabinet door is closed.

It may therefore be seen that the present invention teaches a locking mechanism which may be installed to releasably secure a single drawer or a cabinet door. The hidden locking mechanism of the present invention is completely invisible unless and until the drawer or the cabinet door is partially opened. As such, it allows the drawer or the cabinet door on which it is installed to be opened sufficiently to allow access to the locking mechanism so that it may be unlocked, but it effectively denies access to the contents of the drawer or the cabinet unless and until it is unlocked.

The hidden locking mechanism of the present invention is quick and easy to lock and unlock. It is sufficiently flexible to allow its use on a variety of different size and configuration drawers and cabinet doors without requiring a wide variety of different configurations to be provided, and it is installable using only simple hand tools. The hidden locking mechanism of the present invention is configurable as either a key lock or a combination lock, and it categorically prevents children from unlocking the locking mechanism unless they have the key or the combination.

The hidden locking mechanism of the present invention is of a construction which is both durable and long lasting, and which will require little or no maintenance to be provided by the user throughout its operating lifetime. The hidden locking mechanism of the present invention is also of relatively inexpensive construction to enhance its market appeal and to thereby afford it the broadest possible market. Finally, all of the aforesaid advantages and objectives of the hidden locking mechanism of the present invention are achieved without incurring any substantial relative disadvantage.

DESCRIPTION OF THE DRAWINGS

These and other advantages of the present invention are best understood with reference to the drawings, in which.

DETAILED DESCRIPTION OF THE PREFERRED EMBODIMENT

Figure 1:
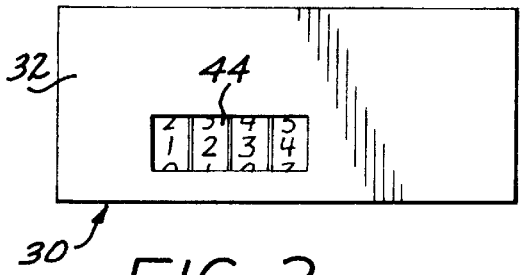
FIG. 1 is a top plan view of a retention mechanism constructed according to the teachings of the present invention, showing a combination lock.
Figure 4:
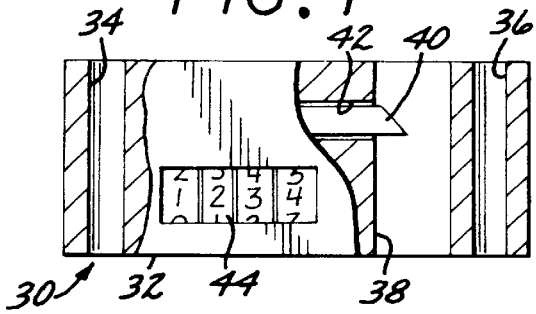
FIG. 4 is a partially cutaway view of the retention mechanism illustrated in FIGS. 1 through 3, better showing the tumbler located within the retention mechanism.
Figure 2:
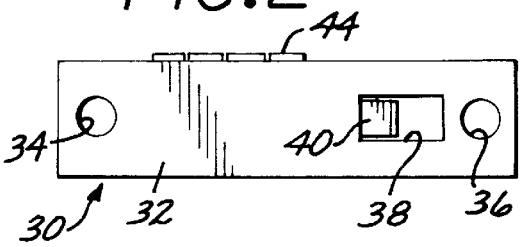
FIG. 2 is a front side view of the retention mechanism illustrated in FIG. 1, showing two mounting apertures and an aperture into which an engaging bolt may be inserted, with a tumbler visible within this aperture.
Figure 5:
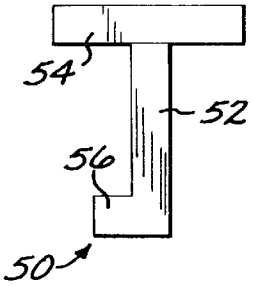
FIG. 5 is a top plan view of a bolt assembly having a mounting plate located at one end thereof and a projection located at the opposite end thereof for engagement with the tumbler contained within the retention mechanism illustrated in FIG. 4.
Figure 6:
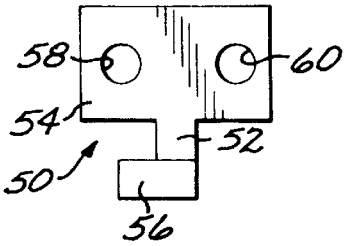
FIG. 6 is a front side view of the bolt assembly illustrated in FIG. 5, showing two apertures contained in the mounting plate.
Figure 7:
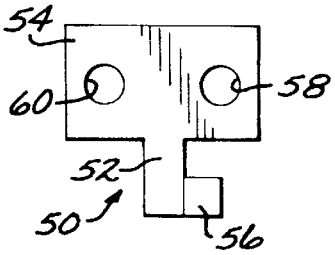
FIG. 7 is a back side view of the bolt assembly illustrated in FIGS. 5 and 6.

The preferred embodiment of the hidden locking mechanism of the present invention comprises two components: a retention mechanism, a first embodiment of which is illustrated in FIGS. 1 through 4, and a bolt assembly, a first embodiment of which is illustrated in FIGS. 5 through 7. Referring first to FIGS. 1 through 4, a retention mechanism 30 is illustrated. The retention mechanism 30 consists of a housing member 32 having two apertures 34 and 36 extending therethrough from front to back near the left and right sides of the housing member 32 respectively as best illustrated in FIGS. 2 and 4. The two apertures 34 and 36 may be used to mount the retention mechanism 30 onto a surface (this process will be discussed below in conjunction with the description of FIGS. 8 and 9).

The retention mechanism 30 has an aperture 38 of rectangular cross section which extends therethrough from front to back intermediate the apertures 34 and 36 and nearer the aperture 36. Located inside the housing member 32 is a tumbler 40 which slides longitudinally within a cylindrical aperture 42. The cylindrical aperture 42 intersects the rectangular aperture 38 within the housing member 32, and is essentially orthogonal to the rectangular aperture 38.

The tumbler 40 is used to selectively engage a bolt inserted into the rectangular aperture 38. The distal tip of the tumbler 40 which extends into the rectangular aperture 38 as best illustrated in FIG. 4 is oblique such that a bolt inserted into the rectangular aperture 38 from the rear of the housing member 32 (shown on the top side of the housing member 32 in FIG. 4) will tend to drive the tumbler 40 into the cylindrical aperture 42, thereby allowing a bolt to be engaged in the retention mechanism 30.

Located on the top side of the retention mechanism 30 is a combination lock 44 of conventional design which actuates the tumbler 40. When the combination lock 44 is not set to the selected combination, the tumbler 40 will be biased into the position illustrated in FIG. 4, such that the distal end of the tumbler 40 extends into the rectangular aperture 38 (thereby retaining a bolt contained within the retention mechanism 30). When the combination lock 44 is set to the selected combination, the tumbler 40 will be withdrawn into the cylindrical aperture 42 (thereby releasing a bolt located in the rectangular aperture 38 of the retention mechanism 30 to allow the bolt to be freely removed from the retention mechanism 30).

Referring next to FIGS. 5 through 7, a bolt assembly 50 is illustrated. The bolt assembly 50 comprises a bolt member 52 which is attached at its proximal end to the bottom edge of a mounting plate 54 in an orthogonal manner, as best illustrated in FIG. 5. The bolt member 52 has a projection 56 located at its distal end thereof which projection 56 extends outwardly from the side of the bolt member 52.

Figure 3:
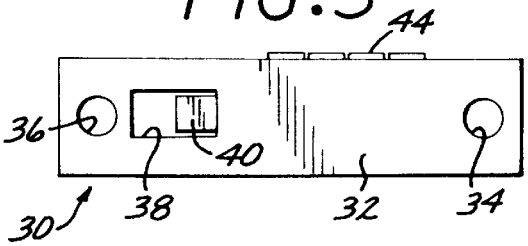
FIG. 3 is a back side view of the retention mechanism illustrated in FIGS. 1 and 2.

It is this projection 56 which will be engaged by the tumbler 40 in the retention mechanism 30 (illustrated in FIGS. 2 through 4) when the distal end of the bolt member 52 is inserted into the rectangular aperture 38 of the retention mechanism 30 (also illustrated in FIGS. 2 through 4). Completing the construction of the bolt assembly 50, there are two apertures 58 and 60 which are located in and extend through the mounting plate 54. The apertures 58 and 60 may be used to mount the bolt assembly 50 onto a surface (this process will be discussed below in conjunction with the description of FIGS. 8 and 9).

It should be noted at this point that a variety of different constructions of the bolt member 52 could be used instead of the construction illustrated in FIGS. 5 through 7, all of which will be readily apparent to those skilled in the art. For example, instead of the projection 56, a notch (not illustrated herein) could be located in the side of the bolt member 52 near the distal end thereof. In this alternate embodiment, the distal end of the tumbler 40 of the retention mechanism 30 (illustrated in FIGS. 2 through 4) will releasably engage this notch in the bolt assembly to secure the bolt assembly within the aperture 34 of the retention mechanism 30 (also illustrated in FIGS. 2 through 4).

Figure 9:
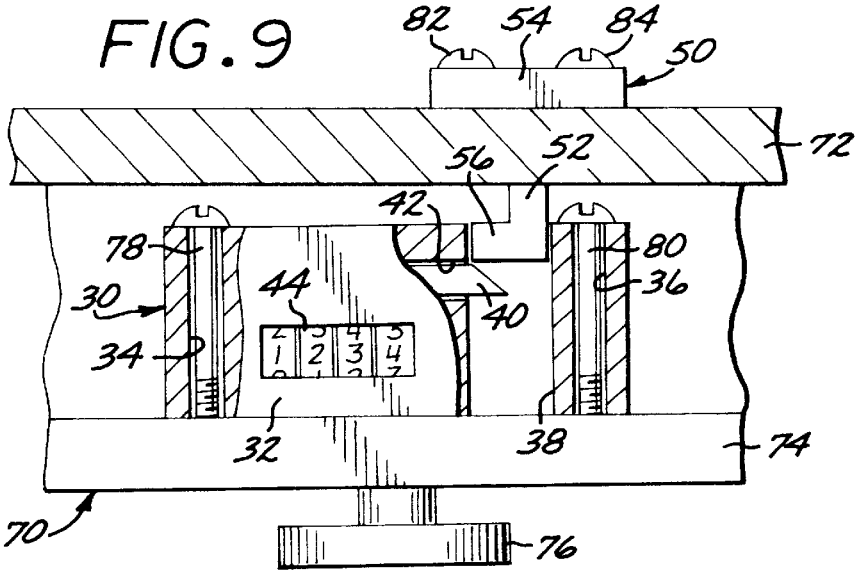
FIG. 9 is a cross-sectional partial view of the drawer and the drawer frame illustrated in FIG. 8, showing the bolt assembly being engaged by the retention mechanism as the drawer is closed.
Figure 8:
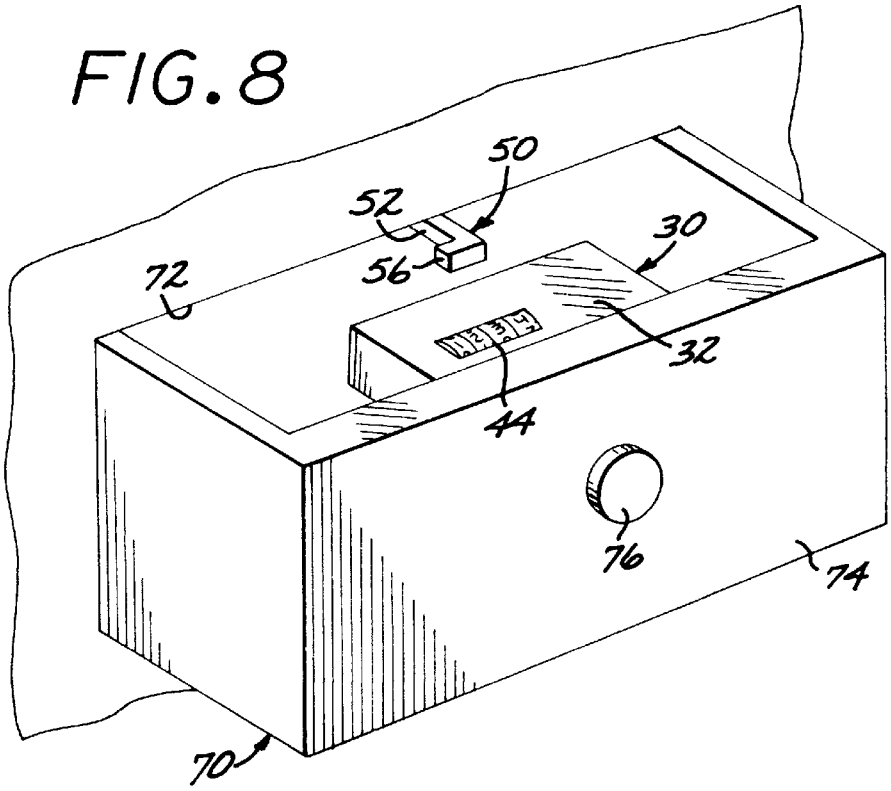
FIG. 8 is an isometric view of a drawer mounted in a drawer frame, with the retention mechanism illustrated in FIGS. 1 through 4 mounted inside the front panel of the drawer and the bolt assembly illustrated in FIGS. 5 through 8 mounted in the top of the drawer frame to be engaged by the retention mechanism when the drawer is closed.

Referring next to FIGS. 8 and 9, the installation of the retention mechanism 30 illustrated in FIGS. 1 through 4 and the bolt assembly 50 illustrated in FIGS. 5 through 7 into a drawer 70 and a drawer frame 72 is illustrated. The drawer 70 has a front panel 74 on which a drawer handle 76 is mounted. The retention mechanism 30 is mounted on the inside of the front panel 74 of the drawer 70 using two screws 78 and 80, which screws 78 and 80 extend through the apertures 34 and 36, respectively, and are then screwed into the front panel 74 of the drawer 70. The retention mechanism 30 is located near the top of the front panel 74 of the drawer 70.

The bolt assembly 50 is mounted on the top of the drawer frame 72 with the mounting plate 54 of the bolt assembly 50 mounted on the inside of the drawer frame 72 and with the bolt member 52 located under the top edge of the drawer frame 72 in a position to be engaged in the rectangular aperture 38 of the retention mechanism 30 as the drawer 70 is closed, as best illustrated in FIG. 9. The bolt assembly 50 is mounted onto the drawer frame 72 using two screws 82 and 84 which extend through the apertures 58 and 60, respectively, in the mounting plate 54 of the bolt assembly 50 and are then screwed into the drawer frame 72.

In operation, when the drawer 70 is closed, the bolt member 52 of the bolt assembly 50 moves into the rectangular aperture 38 of the retention mechanism 30, with the projection 56 of the bolt assembly 50 moving past the tumbler 40 of the retention mechanism 30 to lock the drawer 70. The bolt member 52 of the bolt assembly 50 is sufficiently long to allow the drawer 70 to open sufficiently to expose the combination lock 44 of the retention mechanism 30 with the projection 56 of the bolt assembly 50 not moving past the tumbler 40 of the retention mechanism 30. By setting the combination lock 44 to the correct combination, the tumbler 40 will be withdrawn, allowing the projection 56 of the bolt assembly 50 to be removed from the rectangular aperture 38 of the retention mechanism 30 and the drawer 70 to be fully opened.

Figure 10:
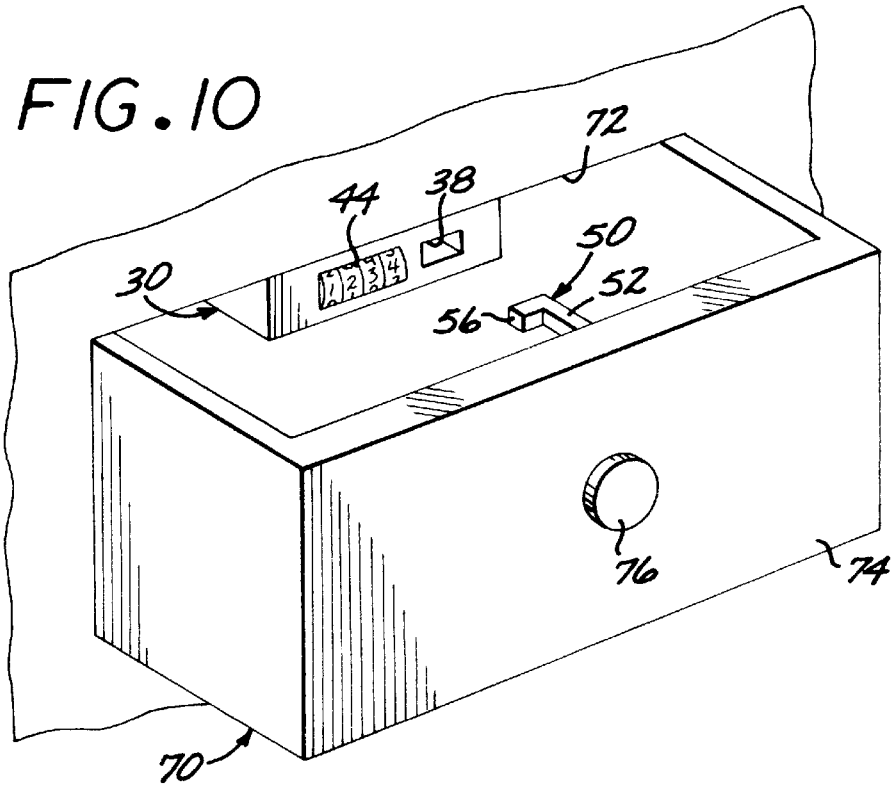
FIG. 10 is an isometric view of the drawer and the drawer frame illustrated in FIG. 8, but with the retention mechanism mounted in the top of the drawer frame and the bolt mounted inside the front panel of the drawer.

In an alternate embodiment which is illustrated in FIG. 10, the bolt 50 may be mounted on the inside of the front panel 74 of the drawer 70 and the retention mechanism 30 may be mounted under the top side of the drawer frame 72. In this embodiment, the oblique distal end of the tumbler 40 (illustrated in FIG. 4) in the retention mechanism 30 would be turned toward the front of the retention mechanism 30. Again, the retention mechanism 30 will be completely hidden when the drawer 70 is closed.

In this embodiment, as the drawer 70 is closed, the bolt member 52 of the bolt assembly 50 again moves into the rectangular aperture 38 of the retention mechanism 30, with the projection 56 of the bolt assembly 50 moving past the tumbler 40 of the retention mechanism 30 to lock the drawer 70. The length of the bolt member 52 of the bolt assembly 50 is sufficient to allow the drawer 70 to open enough to expose the combination lock 44 of the retention mechanism 30 with the projection 56 of the bolt assembly 50 still engaged by the tumbler 40 of the retention mechanism 30. By setting the correct combination on the combination lock 44, the tumbler 40 will be withdrawn, freeing the projection 56 and allowing the bolt assembly 50 to be removed from the rectangular aperture 38 of the retention mechanism 30 and the drawer 70 fully opened.

Figure 11:
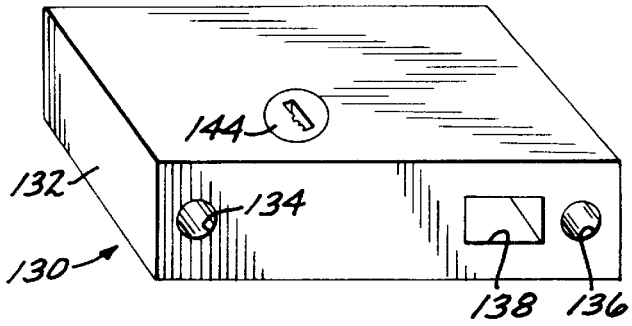
FIG. 11 is an isometric view of a retention mechanism similar to the retention mechanism illustrated in FIGS. 1 through 4, except that the retention mechanism in FIG. 11 is operable by a key.

Referring next to FIG. 11, an alternate embodiment retention mechanism 130 is illustrated which consists of a housing member 132 having two apertures 134 and 136 extending therethrough which may be used to mount the retention mechanism 130. The retention mechanism 130 has a rectangular aperture 138 extending therethrough. Not shown in FIG. 11 is a tumbler which slides longitudinally within a cylindrical aperture located inside the housing member 132 similar to the operation of the tumbler 40 in the cylindrical aperture 42 of the retention mechanism 30 (illustrated in FIG. 4). The cylindrical aperture intersects and is essentially orthogonal to the rectangular aperture 138 in the housing member 132.

Located on the top side of the retention mechanism 130 is a key lock 144 of conventional design which actuates the tumbler in the retention mechanism 130. When the key lock 144 is locked, the tumbler in the retention mechanism 130 will be biased to partially obstruct the rectangular aperture 138 (thereby retaining a bolt within the retention mechanism 130). When the key lock 144 is unlocked, the tumbler in the retention mechanism 130 will be withdrawn into the cylindrical aperture in the retention mechanism 130 (thereby releasing a bolt located in the rectangular aperture 138 of the retention mechanism 130 to allow the bolt to be freely removed from the retention mechanism 130).

Figure 12:
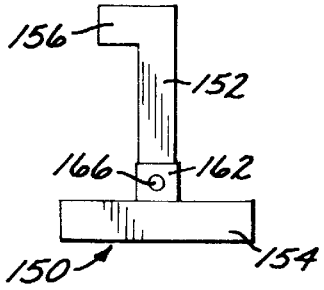
FIG. 12 is a top plan view of a bolt assembly which is pivotally mounted on a mounting plate so that it may be swung to the side, with the bolt illustrated in a deployed position.
Figure 13:
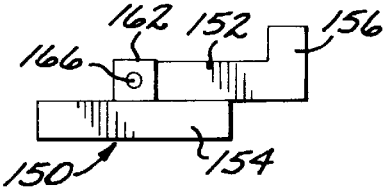
FIG. 13 is a top plan view of the bolt assembly illustrated in FIG. 12, with the bolt swung to the side.
Figure 14:
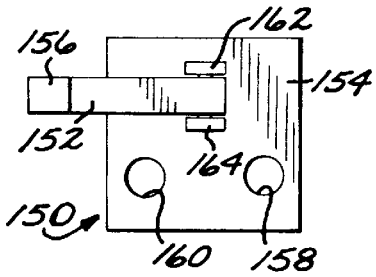
FIG. 14 is a rear view of the bolt assembly illustrated in FIGS. 12 and 13, with the bolt swung to the side, and also showing two apertures located in the mounting plate.

Referring now to FIGS. 12 through 14, an alternate embodiment bolt assembly 150 is illustrated. The bolt assembly 150 has a bolt member 152 which is pivotally mounted on a mounting plate 154. The bolt member 152 has a projection 156 located at its distal end thereof which projection 156 extends outwardly from the side of the bolt member 152. Two apertures 158 and 160 are located in and extend through the mounting plate 154 for use in mounting the bolt assembly 150.

The bolt member 152 is mounted onto the mounting plate 154 using a pivot apparatus. Two parallel spaced-apart flanges 162 and 164 extend outwardly from the surface of the mounting plate 154, with the proximal end of the bolt member 152 being located intermediate the flanges 162 and 164. A pin 166 extends through apertures located in the flange 162, the proximal end of the bolt member 152, and the flange 164.

Thus, the bolt member 152 may pivot with respect to the mounting plate 154 between the positions illustrated in FIGS. 12 and 13. When the bolt member 152 is in the position illustrated in FIG. 12, it extends essentially orthogonally from the mounting plate 154; in this position, it will engage the retention mechanism 30 (illustrated in FIG. 8) or the retention mechanism 130 (illustrated in FIG. 10) when the drawer 70 is closed. When the bolt member 152 is in the position illustrated in FIG. 13, it is folded flush with the mounting plate 154; in this position, it will not engage the retention mechanism 30 (illustrated in FIG. 8) or the retention mechanism 130 (illustrated in FIG. 10) when the drawer 70 is closed.

Figure 15:
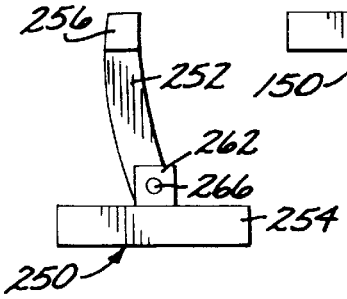
FIG. 15 is a top plan view of a bolt assembly which is curved for use with a retention mechanism used on a hinged cabinet door.
Figure 16:
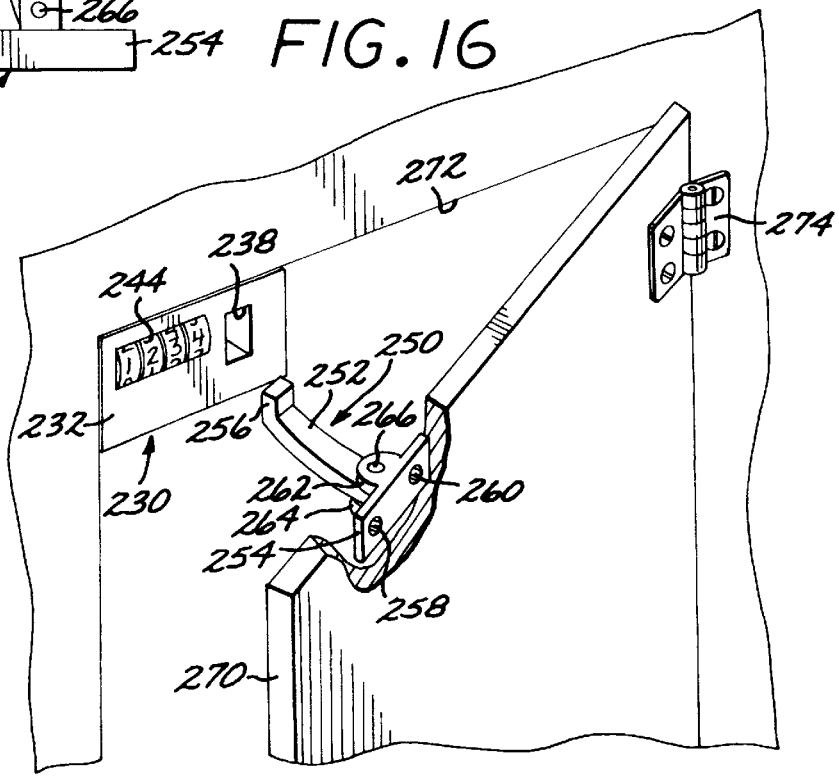
FIG. 16 is an isometric view of a cabinet door hinged on a frame, with the bolt assembly illustrated in FIG. 16 mounted on the cabinet door (which is partially cut away for clarity), and also showing a retention mechanism which is mounted at the top of the frame and which has an aperture located therein for engaging the bolt assembly as the cabinet door is closed.

Referring now to both FIGS. 15 and 16, another alternate embodiment bolt assembly 250 is illustrated. The bolt assembly 250 has a curved bolt member 252 which is pivotally mounted on a mounting plate 254. The curved bolt member 252 is also designed for use with a cabinet door 270 rather than with a drawer. The curved bolt member 252 has a projection 256 located at its distal end thereof which projection 256 extends upwardly from the side of the curved bolt member 252. Two apertures 258 and 260 are located in and extend through the mounting plate 254 for use in mounting the bolt assembly 250.

The curved bolt member 252 is mounted onto the mounting plate 254 using two parallel spaced-apart flanges 262 and 264 which extend outwardly from the surface of the mounting plate 254, with the proximal end of the curved bolt member 252 being located intermediate the flanges 262 and 264. A pin 266 extends through apertures located in the flange 262, the proximal end of the curved bolt member 252, and the flange 264. Like the bolt member 152 in the bolt assembly 150 (illustrated in FIGS. 12 through 14), the curved bolt member 252 may pivot with respect to the mounting plate 254.

Referring to FIG. 16, another alternate retention mechanism 230 is illustrated. The retention mechanism 230 illustrated consists of a housing member 232 having two apertures (not shown) extending therethrough from the bottom side to the top side thereof which may be used together with two screws (also not shown) to mount the retention mechanism 230 underneath the top edge of the door frame 272 in which the cabinet door 270 is mounted using hinges 274. The retention mechanism 230 has a rectangular aperture 238 extending therethrough.

Not shown in FIG. 16 is a tumbler which slides longitudinally within a cylindrical aperture located inside the housing member 232 similar to the operation of the tumbler 40 in the cylindrical aperture 42 of the retention mechanism 30 (illustrated in FIG. 4). The cylindrical aperture is essentially orthogonal to and intersects the top portion of the rectangular aperture 238 in the housing member 232.

Located on the front side of the retention mechanism 230 is a combination lock 244 which actuates the tumbler in the retention mechanism 230. When the combination lock 244 is not set to the selected combination, the tumbler in the retention mechanism 230 will be biased to partially obstruct the rectangular aperture 238 (thereby retaining the curved bolt member 252 within the retention mechanism 230). When the combination lock 244 is set to the selected combination, the tumbler in the retention mechanism 230 will be withdrawn into the cylindrical aperture in the retention mechanism 230 (thereby releasing the curved bolt member 252 located in the rectangular aperture 238 of the retention mechanism 230 to allow the bolt to be freely removed from the retention mechanism 230).

It may therefore be appreciated from the above detailed description of the preferred embodiment of the present invention that it teaches a locking mechanism which may be installed to releasably secure a single drawer or a cabinet door. The hidden locking mechanism of the present invention is completely invisible unless and until the drawer or the cabinet door is partially opened. As such, it allows the drawer or the cabinet door on which it is installed to be opened sufficiently to allow access to the locking mechanism so that it may be unlocked, but it effectively denies access to the contents of the drawer or the cabinet unless and until it is unlocked.

The hidden locking mechanism of the present invention is quick and easy to lock and unlock. It is sufficiently flexible to allow its use on a variety of different size and configuration drawers and cabinet doors without requiring a wide variety of different configurations to be provided, and it is installable using only simple hand tools. The hidden locking mechanism of the present invention is configurable as either a key lock or a combination lock, and it categorically prevents children from unlocking the locking mechanism unless they have the key or the combination.

The hidden locking mechanism of the present invention is of a construction which is both durable and long lasting, and which will require little or no maintenance to be provided by the user throughout its operating lifetime. The hidden locking mechanism of the present invention is also of relatively inexpensive construction to enhance its market appeal and to thereby afford it the broadest possible market. Finally, all of the aforesaid advantages and objectives of the hidden locking mechanism of the present invention are achieved without incurring any substantial relative disadvantage.

Although an exemplary embodiment of the hidden locking mechanism of the present invention has been shown and described with reference to particular embodiments and applications thereof, it will be apparent to those having ordinary skill in the art that a number of changes, modifications, or alterations to the invention as described herein may be made, none of which depart from the spirit or scope of the present invention. All such changes, modifications, and alterations should therefore be seen as being within the scope of the present invention.

What is claimed is:

1. A locking system comprising a moveable member, a fixed member and a concealed locking device, said concealed locking device comprising:

a bolt member having a proximal end and a distal end;

a support member mounted on one of the moveable and fixed member, said proximal end of said bolt member being mounted on and extending from said support member;

a retention housing member mounted on the other of the moveable and fixed members, said retention housing member having an aperture located therein for receiving said distal end of said bolt member therein, and;

a locking mechanism located in said retention housing member and moveable between an unlocked position in which said distal end of said bolt member may be freely withdrawn from said retention housing member and a locked position in which said distal end of said bolt member is prevented from being withdrawn from said retention housing member but is allowed to move between a first position in which said proximal end of said bolt member is fully inserted into said retention housing member and said moveable member is closed and a second position in which said proximal end of said bolt member is partially withdrawn from said retention housing member and said moveable member is slightly opened;

wherein said retention housing member is hidden from view when said bolt member is in said first position and visible when said bolt member is in said second position.

2. The system as defined in claim 1, wherein said bolt member additionally comprises:

a first engagement element located on said distal end of said bolt member.

3. The system as defined in claim 2, wherein said first engagement element comprises:

a projection located at said distal end of said bolt member, said projection extending orthogonally outwardly from said bolt member.

4. The system as defined in claim 2, wherein said first engagement element comprises:

a notch located at said distal end of said bolt member on a side thereof.

5. The system as defined in claim 1, wherein said support member comprises:

a mounting plate, said bolt member being attached at said proximal end thereof to said mounting plate in an essentially orthogonal manner.

6. The system as defined in claim 5, wherein said mounting plate has a plurality of apertures located therein to facilitate mounting said mounting plate on a surface.

7. The system as defined in claim 5, wherein said bolt member is pivotally mounted onto said mounting plate in a manner permitting said bolt member to move between a deployed position in which said bolt member projects essentially orthogonally from said mounting plate and a stored position in which said bolt member is folded essentially flush with said mounting plate.

8. The system as defined in claim 1, wherein the moveable member is a cabinet door and the fixed member is a cabinet frame, the cabinet door being hingedly mounted on the cabinet frame, and wherein said bolt member is curved.

9. The system as defined in claim 1, wherein said retention housing member comprises:

two apertures extending through said retention housing member near opposite sides of said retention housing member, said two apertures for use in mounting said retention housing member on a surface.

10. The system as defined in claim 9, wherein said lock mechanism comprises:

a combination lock.

11. The system as defined in claim 9, wherein said lock mechanism comprises:

a key lock.

12. A concealed locking mechanism as defined in claim 1, wherein said bolt member comprises:

a first engagement element located on said distal end of said bolt member; and wherein said locking mechanism comprises:

a lock installed in said retention housing member; and a second engagement element located in said retention housing member, said second engagement element being driven by said lock between an unlocked position in which said second engagement element is disengaged from said first engagement member to allow said distal end of said bolt member to be withdrawn from said retention housing member and a locked position in which said second engagement element engages said first engagement member and prevents said distal end of said bolt member from being withdrawn from said retention housing member.

13. The system as defined in claim 12, wherein said second engagement element is configured to allow said distal end of said bolt member to be inserted into said aperture in said retention housing member even when said second engagement element is in said locked position.

14. The system as defined in claim 1 wherein the moveable member is a drawer and the fixed member is a drawer frame, wherein said support member is mounted on the top of the drawer frame and said retention housing member is mounted in the inside of the front of the drawer.

15. The system as defined in claim 1 wherein the moveable member is a drawer and the fixed member is a drawer frame, wherein said retention housing member is mounted on the underside of the top of the drawer frame and said support member is mounted in the inside of the front of the drawer.

16. The system as defined in claim 1 wherein the fixed member is a cabinet frame and the moveable member is a cabinet door hingedly mounted in the cabinet frame, wherein said support member is mounted on the cabinet frame and said retention housing member is mounted on the inside of the cabinet door.

17. The system as defined in claim 1 wherein the fixed member is a cabinet frame and the moveable member is a cabinet door hingedly mounted in the cabinet frame, wherein said retention housing member is mounted on the cabinet frame and said support member is mounted on the inside of the cabinet door.

18. A system comprising a moveable member, a fixed member and a concealed locking mechanism, said concealed locking mechanism comprising:

a bolt member having a proximal end and a distal end;

a support member mounted on a surface which is one of the moveable and fixed member, said proximal end of said bolt member being mounted on and extending from said support member;

a first engagement element located on said distal end of said bolt member;

a retention housing member mounted a surface which is the other of the moveable and fixed members, said retention housing member having an aperture located therein for receiving said distal end of said bolt member therein, and;

a lock installed in said retention housing member, and a second engagement element located in said retention housing member, said second engagement element being driven by said lock between an unlocked position in which said second engagement element is disengaged from said first engagement element to allow said distal end of said bolt member to be withdrawn from said retention housing member and a locked position in which said second engagement element engages said first engagement element and prevents said distal end of said bolt member from being withdrawn from said retention housing member but allows said bolt member to move between a first position in which said proximal end of said bolt member is fully inserted into said retention housing member and said moveable member is closed and a second position in which said proximal end of said bolt member is partially withdrawn from said retention housing member and said moveable member is slightly opened;

wherein said retention housing member is hidden from view when said bolt member is in said first position and visible when said bolt member is in said second position.

19. A concealed locking device in combination with a drawer mounted in a drawer frame, said concealed locking device comprising:

a bolt member having a proximal end and a distal end;

a support member, said proximal end of said bolt member being mounted on and extending from said support member, said support member mounted on the drawer frame;

a retention housing member mounted on the inside of the front of the drawer, said retention housing member having an aperture located therein for receiving said distal end of said bolt member therein, and;

a locking mechanism located in said retention housing member and moveable between an unlocked position in which said distal end of said bolt member may be freely withdrawn from said retention housing member and a locked position in which said distal end of said bolt member is prevented from being withdrawn from said retention housing member but is allowed to move between a first position in which said proximal end of said bolt member is fully inserted into said retention housing member and said drawer is closed and a second position in which said proximal end of said bolt member is partially withdrawn from said retention housing member and said drawer is opened slightly to expose said retention housing member to allow access to said locking mechanism.

20. A concealed locking device in combination with a cabinet door mounted on a cabinet frame, said concealed locking device comprising:

a bolt member having a proximal end and a distal end;

a support member, said proximal end of said bolt member being mounted on and extending from said support member, said support member mounted on the cabinet door;

a retention housing member mounted on the cabinet frame, said retention housing member having an aperture located therein for receiving said distal end of said bolt member therein; and a locking mechanism located in said retention housing member and moveable between an unlocked position in which said distal end of said bolt member may be freely withdrawn from said retention housing member and a locked position in which said distal end of said bolt member is prevented from being withdrawn from said retention housing member but is allowed to move between a first position in which said proximal end of said bolt member is fully inserted into said retention housing member and said cabinet door is closed and a second position in which said proximal end of said bolt member is partially withdrawn from said retention housing member and said cabinet door is opened slightly to expose said retention housing member to allow access to said locking mechanism.

21. A method of releasably securing a furniture storage compartment having moveable and fixed members, said method comprising:

mounting a support member on one of the moveable and fixed members, a bolt member having a proximal end and a distal end being mounted with its said proximal end extending from said support member;

mounting a retention housing member on the other of the moveable and fixed members, said retention housing member having an aperture located therein for receiving said distal end of said bolt member therein; and moving a locking mechanism located in said retention housing member between an unlocked position in which said distal end of said bolt member may be freely withdrawn from said retention housing member and a locked position in which said distal end of said bolt member is prevented from being withdrawn from said retention housing member but is allowed to move between a first position in which said proximal end of said bolt member is fully inserted into said retention housing member and said moveable member is closed and a second position in which said proximal end of said bolt member is partially withdrawn from said retention housing member and said moveable member is opened slightly to expose said retention housing member to allow access to said locking mechanism.

22. A concealed locking device in combination with a furniture storage compartment with a moveable member and a fixed member sized to receive the moveable member in the closed position and capable of being opened and closed and locked and unlocked in the closed position, said concealed locking device being associated with said moveable member and said fixed member and further comprising:

a) a bolt member having a proximal end and a distal end;

b) a support member, said proximal end of said bolt member being mounted on and extending from said support member, said support member mounted on one of the moveable and fixed members;

c) a retention housing member mounted on the other of the fixed and moveable members, said retention housing member having an aperture located therein;

d) a locking mechanism located in said retention housing member and moveable between an unlocked position in which said distal end of said bolt member may be freely withdrawn from said retention housing member and a locked position in which said distal end of said bolt member is prevented from being withdrawn from said retention housing member but is allowed to move between a first position in which said proximal end of said bolt member is fully inserted into said retention housing member and said moveable member is closed and a second position in which said proximal end of said bolt member is partially withdrawn from said retention housing member and said moveable member is slightly opened, said locking mechanism having a locking element selected from the class consisting of a combination lock or a key operated lock; and wherein said retention housing member is hidden from view when said bolt member is in said first position and visible when said bolt member is in said second position.

* * * * *